US006296402B1

(12) United States Patent
Yamamoto et al.

(10) Patent No.: US 6,296,402 B1
(45) Date of Patent: Oct. 2, 2001

(54) FILM SUPPLY APPARATUS

(75) Inventors: Takuya Yamamoto; Masaki Kitahara, both of Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 09/571,165

(22) Filed: May 16, 2000

(30) Foreign Application Priority Data

May 17, 1999 (JP) ..... 11-135696
Nov. 24, 1999 (JP) ..... 11-332942

(51) Int. Cl.[7] ..... G03D 17/00; G03D 3/08
(52) U.S. Cl. ..... 396/599; 396/612
(58) Field of Search ..... 396/567–570, 396/612, 599, 617, 620; 355/27–29, 75, 76

(56) References Cited

U.S. PATENT DOCUMENTS 3,746,444 * 7/1973 Kahle et al. ..... 355/28
5,483,317 * 1/1996 Tanibata ..... 396/567
5,541,699 * 7/1996 Yamaguchi ..... 396/567

FOREIGN PATENT DOCUMENTS 0254845 9/1992 (JP) .

* cited by examiner

*Primary Examiner*—D. Rutledge
(74) *Attorney, Agent, or Firm*—Smith Patent Office

(57) ABSTRACT

A film supply apparatus is provided wherein one film is held in a waiting position while a first film is being processed and the waiting film is automatically processed after the processing of the first film has been completed. The apparatus comprises a film holding supply mechanism with a film nip section that nips the film at a film waiting position, a film moving mechanism for moving the film from the film waiting position to a film supply position and a driving mechanism for nipping and transferring the film between it and the film moving mechanism. The film moving mechanism is configured to return to the film waiting position after a predetermined portion of the first film has been transferred and wherein after the film moving mechanism has returned to the film waiting position, the next film can be nipped using the film nip section at the film waiting position.

17 Claims, 9 Drawing Sheets

FILM SUPPLY APPARATUS

BACKGROUND OF THE INVENTION

1. Field of the Invention

This invention relates to a film supply apparatus and more particularly to a film supply apparatus which implements an automatic film supply process with a simpler configuration.

2. Discussion of the Related Art

Conventionally, a film supply apparatus according to a first prior art structure is configured so as to transfer and process films, one by one. In processing a plurality of films according to the first prior art structure, an operator needs to repeatedly insert film into the film supply apparatus. After the completion of the processing of this film, the operator inserts the next film into the film carrier repeating the process.

A second prior art structure discloses a film supply apparatus which sequentially processes a huge amount of film, such as the device disclosed in Japanese patent application publication no. 4-254845.

The prior art structures described above have disadvantages that are described below.

In the first prior art structure, during processing of the first film, the operator needs to perform various operations, such as confirmation of scanner determined images, packing of a processed film into a bag, etc., therefore the operator can not stand waiting for completion of the first film and then set the next film or do other necessary operations immediately after the processing is completed. Also, during the processing of the first film, even if it is desired to start processing a next film, it is not possible until the current film processing is completed. According to the first prior art structure, there is also a disadvantage that it takes some time before setting a next or subsequent film so that it can start to become processed. During this time it is difficult to avoid stopping a photo processing apparatus and thus the photo processing apparatus does not perform to its capacity.

Also according to the second prior art structure, such a film supply apparatus for large volume processing has disadvantages that in that it is complicated in its structure, it is large in size and it is expensive. It occupies too large a space to make it practical for ordinary DPE shops (for developing, printing and enlarging of photographs). Further the second prior art structure has a problem in that the films can be rubbed against each other and can become damaged. Further there is a problem that setting a next film is impossible when all films to be processed were completed due to its overlaying setting. There are also other possible problems with this structure.

SUMMARY OF THE INVENTION

Therefore, the present invention seeks to solve the above problems and disadvantages of the prior art. It is an object of the invention to provide a film supply apparatus with a relatively simple configuration that holds a subsequent film during processing of the first film and the processing of the subsequent film is automatically started after the first film has been processed.

According to the present invention to achieve the above object, a film supply apparatus is provided comprising a film holding supply mechanism. The film holding supply mechanism includes a film nip section that nips a first film at a film waiting position, a film moving device for moving the first film from the film waiting position to a film supply position and a driving mechanism for nipping and transferring the first film between the driving mechanism and the film moving device. The film moving device is configured for returning to the film waiting position after a predetermined portion of the first film has been transferred, and wherein after the film moving device has returned to the film waiting position, another film can be nipped using the film nip section at the film waiting position so as to be in a waiting condition. Herein, the driving mechanism may be a roller section configured to be driven by an electric motor.

In the film supply apparatus according to the present invention, the film moving device is configured to rotate between the film waiting position and the film supply position and the film is in a waiting condition using the film nip section when the film moving means is in the film waiting position. According to the present invention, the film supply apparatus can be provided wherein a subsequent film is held in the waiting condition while the first film is being processed and wherein after processing of the first film has been completed, the processing of the subsequent film is automatically commenced.

Further the film supply apparatus according to the present invention preferably comprises a film holding means or device for operating with the film nip section and holding the film at the film waiting position and a film supply roller section. The film supply roller section is configured so that the film holding means is inclined at an angle so that the film is apt to move from the film holding means to the film supply roller section.

According to this preferred embodiment, the film supply apparatus can be provided wherein the film at the film waiting position can be readily held and wherein the film can be readily moved from the film waiting position to the film supply position.

Further, the film supply apparatus according to the present invention preferably comprises a film mask provided downstream of the film holding supply mechanism and it is configured so that the film mask comprises a transfer roller section. The transfer roller section nips and transfers the film supplied from the film holding supply mechanism and the film moving means can return to the film waiting position after the transfer roller section has nipped the film.

Further, according to the present invention to accomplish the above object, a film supply apparatus is provided comprising a film holding supply mechanism including a film holding section holding a film at a film waiting position, a moving mechanism for moving the film from the film waiting position to a film supply position and a driving mechanism for transferring the film at the film supply position. The moving mechanism returns to the film waiting position after a predetermined portion of the film has been transferred and wherein after the moving mechanism has returned to the film waiting position, another film can be nipped using the film holding section at the film waiting position so as to be in a waiting condition.

Further in the film supply apparatus according to the present invention, preferably the film holding section is comprised of a switching guide section and a open-close guide section located under the film. The open-close guide section is configured to operate in an opening direction in case the switching guide section moves downward and to operate in a closing direction in case the switching guide section moves upward. At the film waiting position, the film is nipped using the switching guide section and the open-close guide section. In moving the film to the film supply position, the switching guide section functions as the moving means by moving from the upper to the lower sides of the film. After a predetermined portion of the film has been transferred using the switching guide section and the driving means, the switching guide section and the open-close guide section can return to the film waiting position.

Further the film supply apparatus according to the present invention, preferably comprises a hook section which operates with the film holding section to hold the film at the film waiting position. The hook section is driven to rotate so as to release a holding condition of the hook section with respect to the film when moving the film from the film waiting position to the film supply position.

Further in the film supply apparatus according to the present invention, the film holding section and the hook section are preferably linked with each other. According to this preferred embodiment, the film can be smoothly moved from the film waiting position to the film supply position by the linked operation of the film holding section and the hook section.

Still further, the film supply apparatus according to the present invention, preferably comprises a film mask provided downstream of the film holding supply mechanism. The film mask comprises a transfer roller section which nips and transfers the film supplied from the film holding supply mechanism. The switching guide section, as the moving means, can return to the film waiting position after the transfer roller section has nipped the film.

Still further, in the film supply apparatus according to the present invention, the film supply position is preferably located just beneath the film waiting position. According to this preferred embodiment, the apparatus can be implemented with a relatively small space as well as allowing the transfer of the film from the film waiting position to the film supply position with a simple mechanism (for example, a vertical mechanism such as the film moving means and the switching guide section).

BRIEF DESCRIPTION OF THE DRAWINGS

The above and other objects and features of the present invention will be clearly understood from the following description with respect to the preferred embodiment thereof when considered in conjunction with the accompanying drawings and diagrams, in which.

DETAILED DESCRIPTION OF THE PREFERRED EMBODIMENTS

Figure 1:
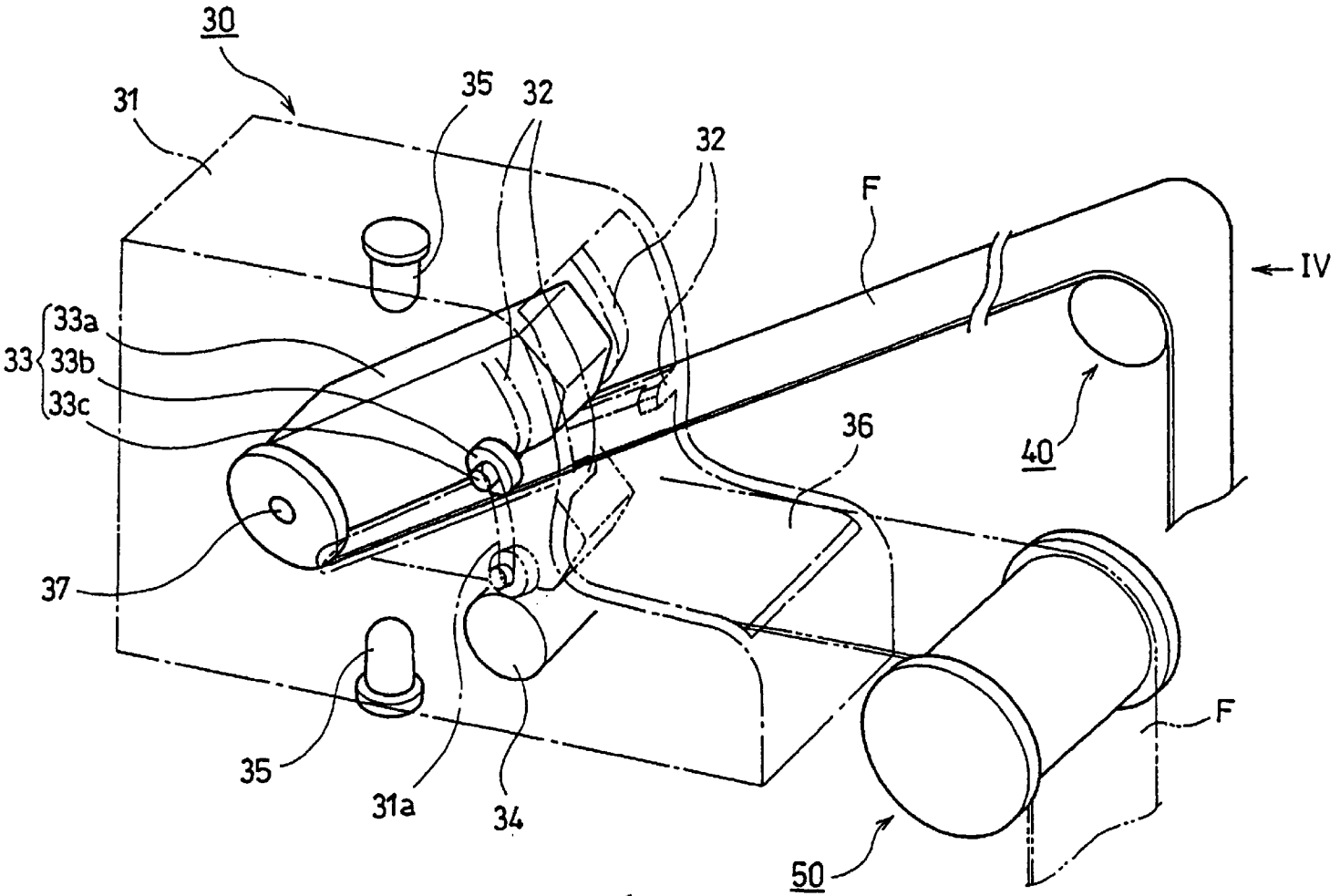
FIG. 1 shows a schematic view of a film holding supply mechanism of a film supply apparatus in accordance with a first embodiment of this invention.
Figure 2:
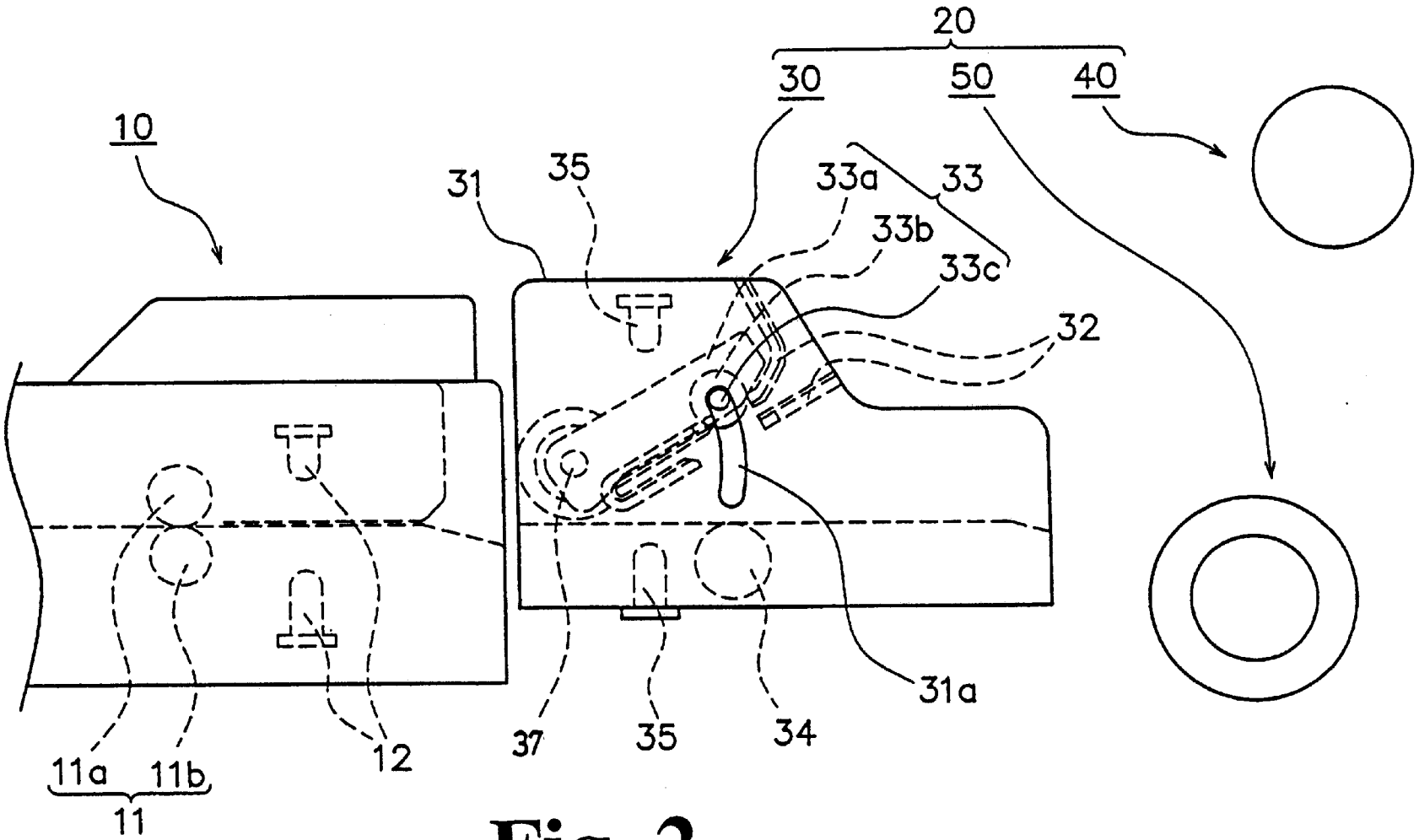
FIG. 2 is a schematic view showing a film moving device of the film supply apparatus in accordance with the embodiment of this invention shown in the film waiting position.
Figure 3:
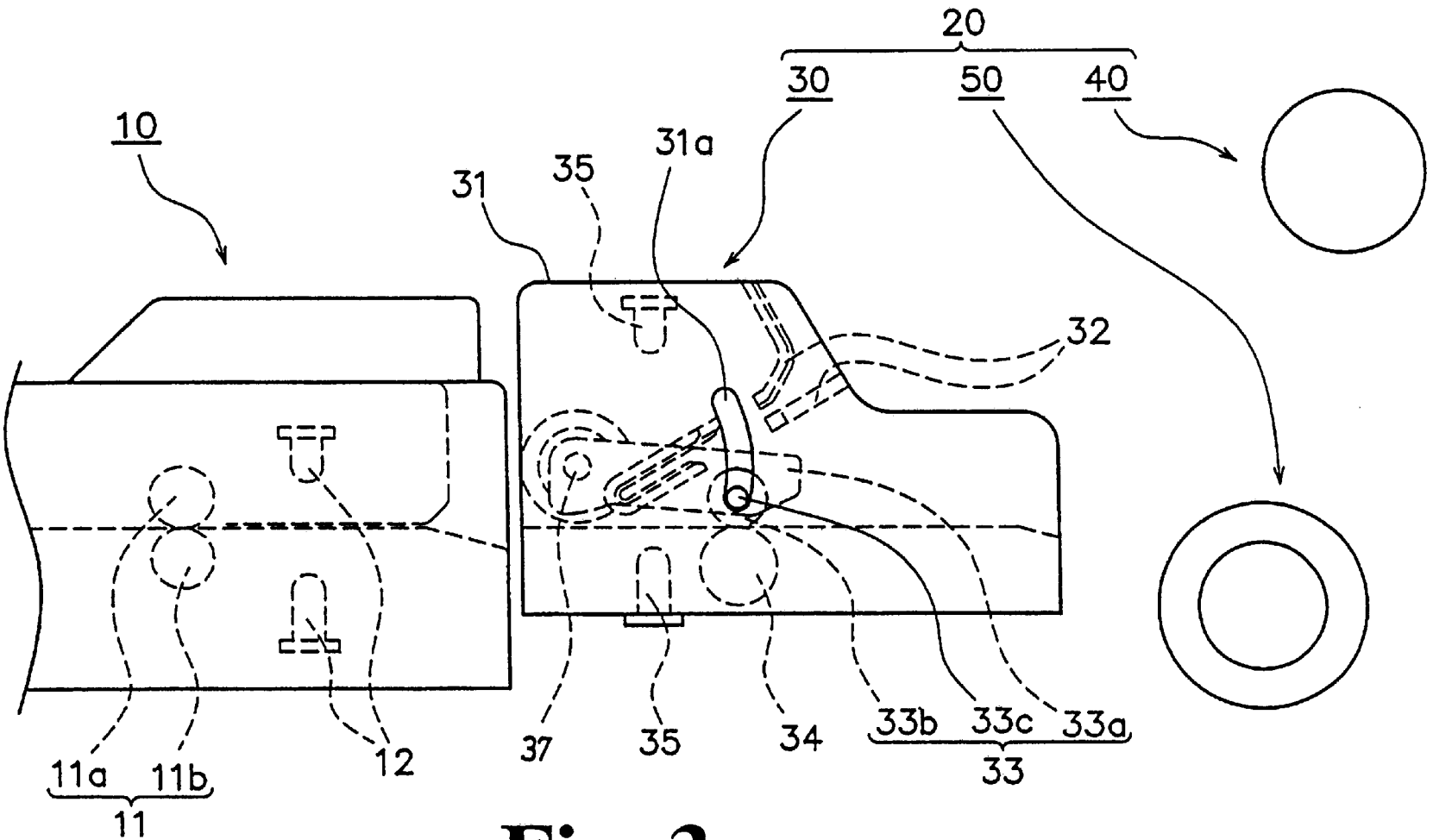
FIG. 3 is a schematic view showing the film moving device of the film supply apparatus in accordance with the embodiment of this invention shown in the film supply position.

FIG. 1 illustrates a schematic diagram of a film holding supply mechanism which is a component of a film supply apparatus in accordance with a first preferred embodiment of the invention. FIGS. 2 and 3 show schematic side views of the film supply apparatus in accordance with the first embodiment. FIG. 2 illustrates a condition of a film transfer device, which is a component of the film holding supply mechanism, in a film waiting position.

In FIGS. 1–3, the film supply apparatus according to this embodiment comprises a film mask 10, a film holding supply mechanism 20, etc. The film holding supply mechanism 20 comprises a film holding supply mechanism main section (hereinafter referred to simply as a "main section") 30, a film holding device 40 and a film supply roller section 50.

The film mask 10 comprises a transfer roller section 11, a sensor section 12, etc. The transfer roller section 11 comprises a pair of rollers comprising an upper roller 11*a* and a lower roller 11*b*. At least one of the rollers is configured to transfer the film into the photo developing apparatus. The sensor section 12 is provided for sensing a position of the film within the film mask 10. The transfer roller section 11 and other components of the film supply apparatus are controlled based on a signal from the sensor section 12 as described in more detail below.

As described above, the film holding supply mechanism 20 comprises the main section 30, the film holding device 40 and the film supply roller section 50.

The main section 30 comprises a main casing 31, a film nip section 32 provided at the inner wall of the main casing 31, and a film moving device 33 configured to move a film F nipped at the film waiting position by the film nip section 32. As shown in FIG. 1, the film waiting position is indicated by a solid line and the film supply position is indicated by a phantom line (two dot chain line). The main section also includes a driving roller 34 nipping the film F with a roller section 33*b* provided at the film moving device to supply the film F, a sensor section 35 detecting the film F and a film transfer passage 36 where the film F is supplied.

The film nip section 32 is configured to suitably nip the film F at the waiting position only with the film nip section or with the film nip section 32 in connection with the film transfer device (positioned at the film waiting position). Also, the film nip section 32 is configured to nip both sides of the film F so as to avoid damage to the film F or to images formed in the film F.

The film moving device 33 comprises a moving device main section 33*a*, the roller section 33*b* and a shaft 33*c* near an end of and below the main section 33*a*. This film moving device 33 is supported with the main casing 31, etc. by a rotating shaft 37. The film moving device 33 is configured to rotate between a film waiting position (see FIG. 2) and a film supply position (see FIG. 3) by having shaft 33*c* being guided in slot 31*a*.

The film holding device 40 is configured to hold the film F when the film F is inserted into the main section 30 and the film moving device 33 is in the film waiting position. The film holding device 40 is also configured to readily remove the film F from the film holding device 40 when the film moving device 33 is moved to the film supply position. In other words, the film F is moved to a position where it can be supplied. For example, the film holding device 40 is constructed as shown in FIG. 4.

Figure 4:
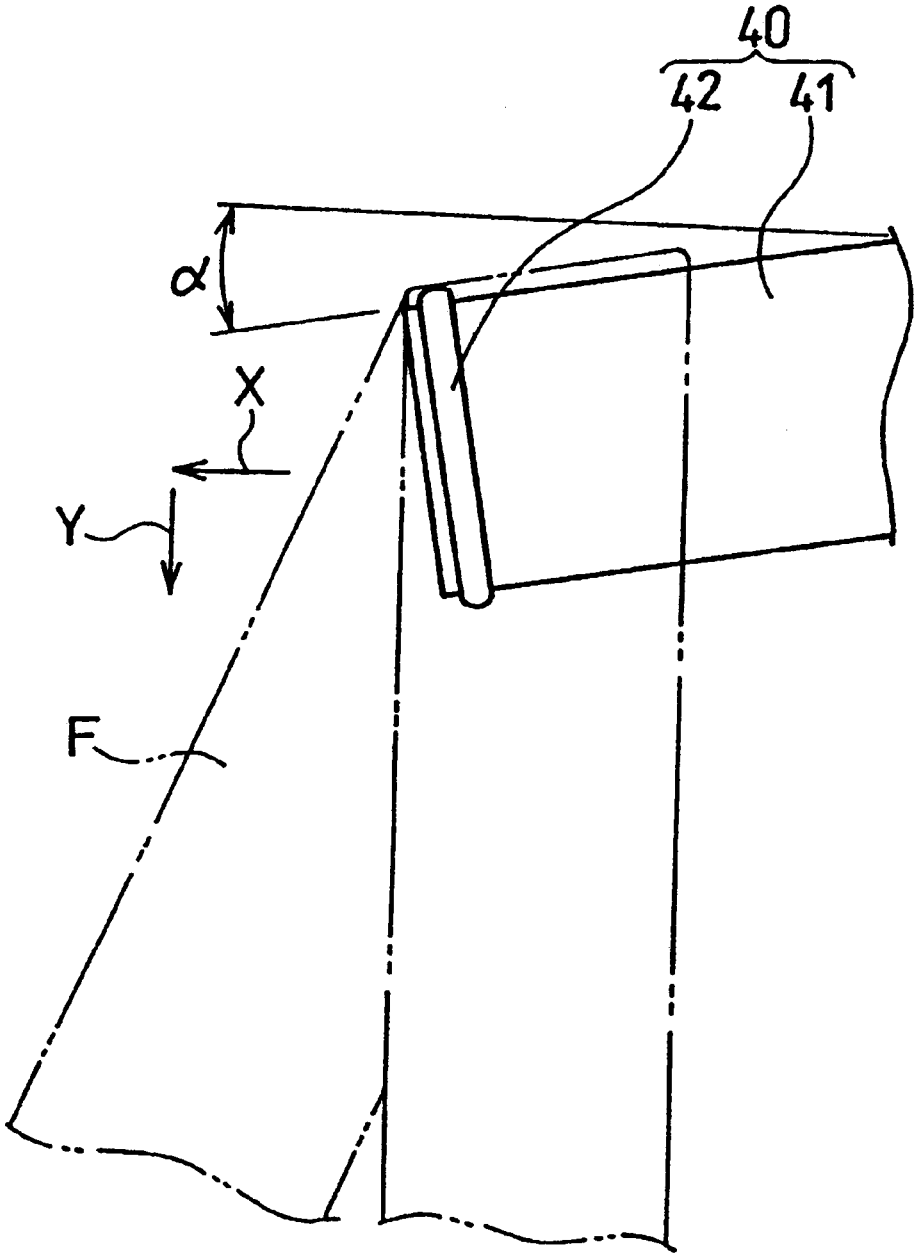
FIG. 4 shows a side view of a film holding device taken in the direction of arrow IV in FIG. 1.

FIG. 4 shows a side view of the film holding device as seen in the direction of arrow IV in FIG. 1. In FIG. 4, the film F, being held by the film holding device 40, is shown as a phantom line. In FIG. 4, the film holding device 40 comprises a guide roller 41, which is a main section of the holding device, and a stopper 42 provided at the end of the guide roller 41. The stopper may be a o-ring shaped part made of rubber, silicon resin or other suitable material. Further herein, the film holding device 40 (guide roller 41) is provided so as to be inclined at an arbitrary angle a (alpha) with respect to the horizontal direction.

In such a film holding device 40, the film F will be held on the guide roller 41 if the film F is in the film waiting position (the film F stands still). When the film moving device 33 moves the film F to the film supply position, the film F will move on the guide roller 41. The film F will move in the inclined direction of the guide roller 41, depart from the film holding device 40 and move to the film supply roller section 50. In other words, the film F will initially move in the direction of an arrow X on the film holding device 40, then move in the direction of arrow Y and fall freely to sit on the film supply roller section 50.

The film roller section 50 is provided at a suitable position to hold the film F after it falls from the film holding device 40 and functions to support a rear side of the film F during the film supply. This film supply roller section 50 is provided with a bearing or another suitable component to prevent excessive friction from acting on the film F during the supply of film F and constructed so that a surface portion of the film supply roller section 50 can rotate freely.

FIG. 5 shows a schematic side view of the film supply apparatus according to the embodiment described above. The operation of the film supply apparatus according to this embodiment will now be described in more detail with reference to FIGS. 1–5.

Figure 5A:
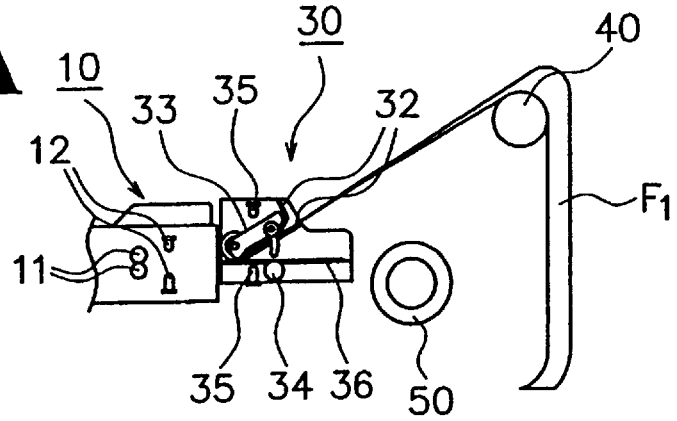
FIGS. 5A, 5B, 5C and 5D show schematic side views of the operation of the film supply apparatus in accordance with the first embodiment of this invention.
Figure 5B:
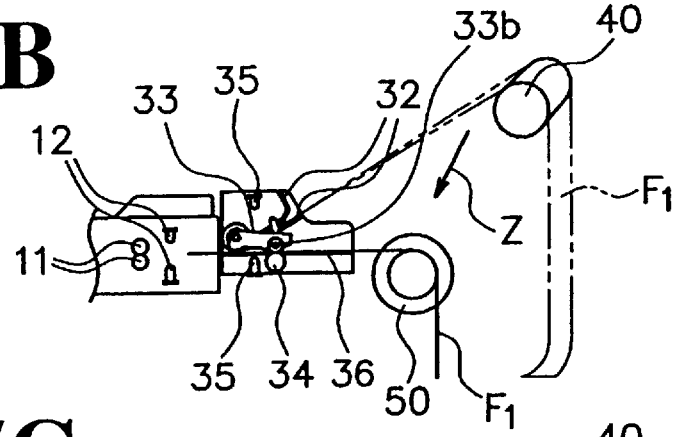

FIG. 5A shows a situation where a first film $F_1$ is in the film waiting position. In this situation, a front side of the first film $F_1$ is nipped by the film nip section 32 while a rear side of the first film $F_1$ is held by the film holding device 40. The sensor section within the film mask 10 (hereinafter referred to as a "first sensor section 12") detects a presence of the film within the film mask 10 or other necessary phenomena. When it is detected that the film can be supplied into the film mask 10, an indicating signal (hereafter called a "suppliable signal") is sent from the sensor section 12 to the film moving device 33. A sensor section provided within the main section 30 (hereafter referred to as "second sensor section 35") detects whether the film is inserted into the main section 30, that is, whether the film is nipped by the film nip section 32. If the film is nipped, a signal indicating so (hereafter referred to as a "nip signal") is sent from the second sensor section 12 to the film moving device 33. After the film moving device 33 has received the suppliable signal and the nip signal, it is rotated to the side of the film transfer passage 36 so as to move the first film F, to the film supply position. FIG. 5B shows that the film moving device 33 has been rotated to the film supply position.

FIG. 5B shows that the first film $F_1$ is set at the film supply position. As the film moving device 33 is rotated to the side of the film transfer passage 36, the first film $F_1$ is pressed against the side of the film transfer passage 36 by the film moving device 33, whereas the rear side of the first film $F_1$ held by the film holding device 40 is pulled in the direction Z and it slides down so that it is supported by the film supply roller section 50. Also, the first film $F_1$ is nipped between the roller section 33*b* and the driving roller 34. The first film $F_1$ will be supplied from the main section 30 into the film mask 10. The rear side of the first film $F_1$ will be transferred through the film supply roller section 50 into the main section 30. In addition, the first film $F_1$ is transferred by way of the roller section 33*b* and the driving roller 34 until it is nipped by the transfer roller section 11 within the film mask 10.

After the first film $F_1$ is nipped by the transfer roller section 11, the nipping of the first film $F_1$ by the film moving device 33 will be released and the film moving device 33 will return to the film waiting position. Then by using the transfer roller section 11, the first sensor section 12 or both, it is determined whether the first film $F_1$ is nipped by the transfer roller section 11. That is, in this determination, a signal indicating that the nipping by the film moving device 33 should be released (hereafter referred to as "nip release signal") will be sent to the film moving device 33 and it will rotate to the film waiting position based on this nip release signal.

Figure 5C:
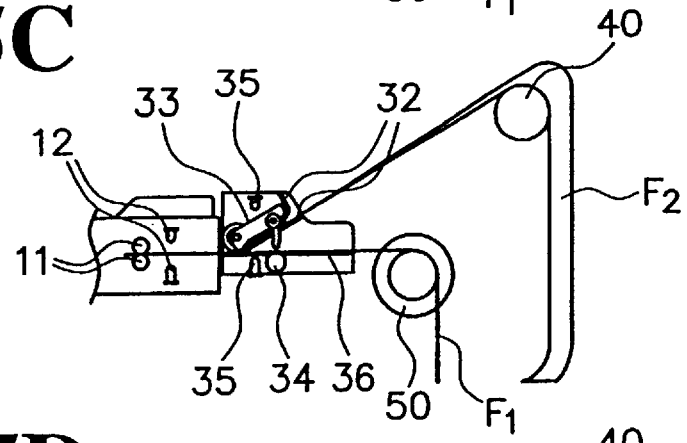

As the film moving device 33 returns to the film waiting position, the film nip section 32 can nip another film. That is, the next film to be processed can be set up in advance. FIG. 5C shows that the next film (second film $F_2$) is set while the first film $F_1$ is being processed. In other words, the second film $F_2$ is nipped by the film nip section 32 while the first film $F_1$ is being transferred with the transfer roller section 11.

FIG. 5C shows that the second film $F_2$ is set at the film waiting position while the first film $F_1$ is being processed. In the situation of FIG. 5C, no suppliable signal is sent from the first sensor section 12 to the film moving device 33 because the first sensor section 12 detects that the first film $F_1$ being processed is within the film mask 10. Accordingly, no suppliable signal will be sent until the first film $F_1$ has been processed to some extent. Specifically, the first sensor section 12 supplies the suppliable signal to the film moving device 33, when the first film has reached a position where it can not interfere with the next to be sent film (second film $F_2$). Thus, the second film $F_2$ will be in a waiting condition until the processing for the first film $F_1$ has reached a predetermined portion, or until the next film processing can be started. Further, FIG. 5D shows that the predetermined processing for the first film $F_1$ has almost been completed.

Figure 5D:
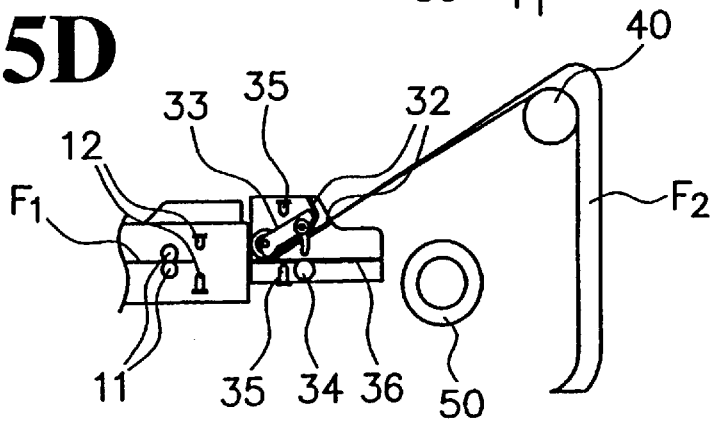

In FIG. 5D, the rear end of the first film $F_1$ has already passed the first sensor section 12. Accordingly, based on the time when the first sensor section 12 has detected this condition, or a detection signal is supplied from other detecting devices (now shown), it can be determined how long time it takes before processing the next film becomes possible. Thus, the completion of the processing for the first film means a return to the starting condition of the processing as shown in FIG. 5A.

When the second film $F_2$ is in the film waiting position, the suppliable signal from the first sensor section 12 and the nip signal from the second sensor section 35 are sent to the film moving device 33. Accordingly, hereafter the above described processing in FIG. 5B and the following is repeated, in other words, the processing in FIG. 5A through 5D is repeated, so as to process a plurality of films.

As described above, in this embodiment, while the operator is waiting during the processing for the first film, the operator can set the next film in the main section 30 and the holding device 40, because the main section 30 is in the waiting condition when the first film is nipped and transferred by the transfer roller 11. Thus, the setting of the next film becomes possible as soon as the processing of the first film has started. Also the setting of the next film is possible during the processing of the first film.

According to this embodiment, a loss of time can be eliminated and the photo processing apparatus can be efficiently operated, since the next film automatically begins to be supplied and transferred into the film mask while the first film is being processed. The film supply apparatus according to this embodiment can be implemented with a reduced cost and a reduced space due to relatively simpler construction compared to the complexity of the prior art structures described above. According to this embodiment, the film supply apparatus that holds the next film in the waiting position during the processing of the first film and wherein the next film is automatically processed after the processing for the first film has been completed, can be provided with a relatively simple construction.

While a specific usage location of the film supply apparatus has not been described in this embodiment, the usage location of this film supply apparatus is not limited to any specific location. Accordingly, it may be used during the supply of the film to a scanning apparatus or during the supply of the film into an exposure apparatus.

While in this embodiment the film holding device 40 has been inclined in advance, the present invention is not limited to this configuration and, for example, it may be configured so that the film holding device becomes inclined in the predetermined direction (in which direction the film F is transferred to the film supply roller section 50) by being linked with the film moving device 33. Alternatively, it may be configured so that any nipping device provided in the film holding device nips and holds the film F when the film F is waiting and releases the film F linked with the film moving device 33 so that the film F is transferred to the film supply roller section 50 when the film F is being supplied.

Also in this embodiment, while it has been described that the film holding device 40 comprises the guide roller 41 and the stopper 42, this embodiment is not limited to this construction. Accordingly, for example it is possible to construct the film holding device without providing a stopper 42. The film holding device may be constructed by modifying the end shape of the guide roller 41 to provide a brim shaped portion at the end portion.

Further in this embodiment, while it has been described that the movement of the film F from the film holding device 40 to the film supply roller section 50 is governed by the free fall and a particular part such as a guide section between the film holding device 40 and the film supply roller section 50 is not provided, this invention is not limited to this construction. Accordingly, for example, a guide section may be provided between the film holding device 40 and the film supply roller section 50 so as to connect these with each other so that the movement of the film can be smoothly performed through this guide section.

Figure 6:
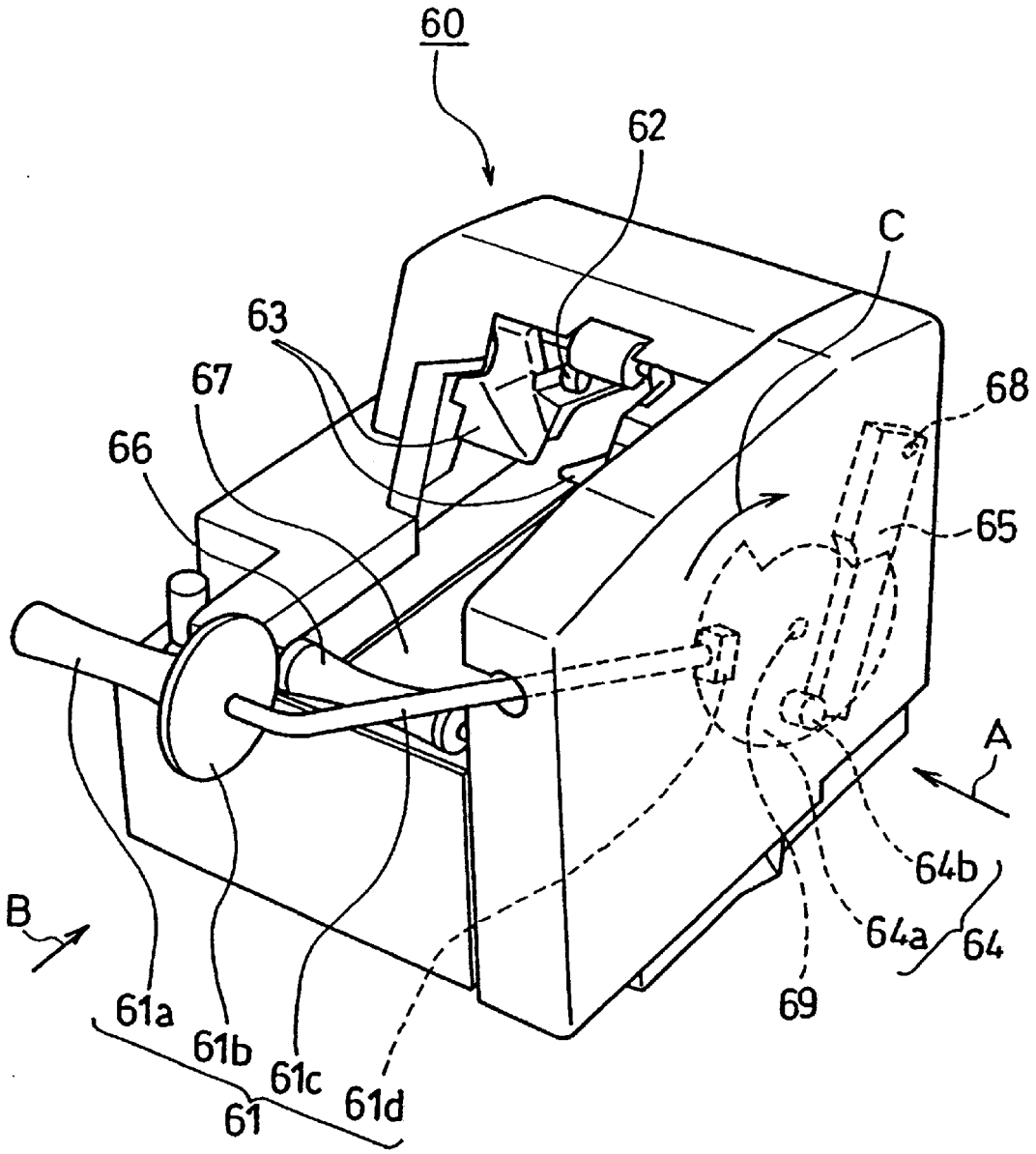
FIG. 6 shows a schematic perspective view of the film holding supply mechanism in accordance with another embodiment of this invention.

FIG. 6 shows a schematic diagram of the film holding supply mechanism of the film supply apparatus according to an embodiment of the present invention. The film supply apparatus of FIG. 6, as well as the above described embodiment, is configured so that the film can be disposed at the two locations, i.e., the film waiting position and the film supply position.

The film supply apparatus according to the embodiment shown in FIG. 6 comprises a film mask (not shown in FIG. 6), a film holding supply mechanism 60, etc.

The film holding supply mechanism 60 shown in FIG. 6 comprises a hook section 61*d* performing a similar function to that of the film holding device illustrated in FIGS. 1–5, a switching guide section 62 performing a function such as that of the film moving device, etc. The film holding supply mechanism comprises an open-close guide section 63 performing the function of holding the film in the film waiting position; a cam section 64 and a rod section 65 that can activate elements such as hook section 61, the switching guide section 62 and the open-close guide section 63; a film supply roller section 66 supporting the film at the film supply position; and a film transfer passage 67 through which the film is supplied to the film supply position. Further in this embodiment, the switching guide section 62 and the open-close guide section 63 are provided as a film holding section which holds a front side of the film at the film waiting position.

The hook section 61*d* comprises: a holding section 61*a* which holds the film in a hooking manner; a side surface guide section 61*b* guiding the side surface of the film held by the holding section 61*a*; a shaft section 61*c* to which the holding section 61*a* and the side surface guide section 61*b*, integrally formed of resin or other suitable material, are attached at one end; and a cam contact section 61*d* fixed to the other end of the shaft section 61*c*, etc. An end section of the holding section 61*a*, located opposite to the side having the side surface guide section 61*b*, is configured to have a larger diameter than that of a center portion of the holding section 61*a*. Thus, the film should be prevented from falling when the film is hooked to the holding section 61*a*.

The switching guide section 62 is connected to the rod section 65 through a rod section rotating shaft 68 and it is configured so as to rotate about the rod section rotating shaft 68 in accordance with the movement of the rod section 65. This switching guide section 62 comprises a switching guide main section 62*a* connected with the rod section 65 through the rod section rotating shaft 68 and a roller section 62*b* provided to contact with a perforation section of the film. The open-close guide section 63 comprises a pair of left and right parts and is configured to laterally and outwardly open in accordance with a downward movement of the switching guide section 62 and inwardly close in accordance with the upward movement of the switching guide section 62. In other words, the open-close guide section 63 is configured so that the pair of left and right parts will be inwardly pressed by way of a pressing device such as a spring.

The cam section 64 comprises a cam main section 64a having a notch formed with a predetermined spacing and a protruding section 64*b* provided at the predetermined location of the cam main section 64a. This cam section 64 is supported by a cam section rotating shaft 69 about which the cam section 64 is rotatable in the direction of arrow C.

An operating condition of the film holding supply mechanism configured in the manner above will now be described with reference to FIGS. 7–9. Specifically, FIGS. 7A, 8A and 9A show schematic side views of the film holding supply mechanism shown in FIG. 6 seen from the direction of arrow A, while FIGS. 7B, 8B and 9B show schematic front views of the film holding supply mechanism seen from the direction of arrow B in FIG. 6.

FIG. 7 shows that in the film holding supply mechanism in accordance with this embodiment a first film Fa is located in the film supply position and a second film Fb is located in the film waiting position. That is, FIG. 7 shows that the first film Fa is transferred on the film transfer passage and the second film Fbis held by way of the hook section 61, the switching guide section 62, the open-close guide section 63, etc.

Here, the first film Fa is transferred and supplied on the film transfer passage 67 by using a driving device provided at the film mask (not shown in FIG. 7) or any other suitable device. The second film Fb is held at the film waiting position without contacting the first film Fa by means of the hook section 61.

A front side end of the second film Fb (supply side end) is nipped between the switching guide section 62 (roller section 62*b*) and the open-close guide section 63. Here, the open-close guide section 63 is pressed in the direction of arrow D of FIG. 7B so that the second film Fb will be effectively nipped and held between the roller section 62*b* and the open guide section 63 without falling onto the film transfer passage. During this nipping, the perforation of the second film Fb will contact the roller section 62*b* and the open-close guide section 63 so that images formed on the second film Fb will not be damaged. A rear end side of the second film Fb is held by hooking it over the holding section 61*a* of the hook section 61.

Figure 7A:
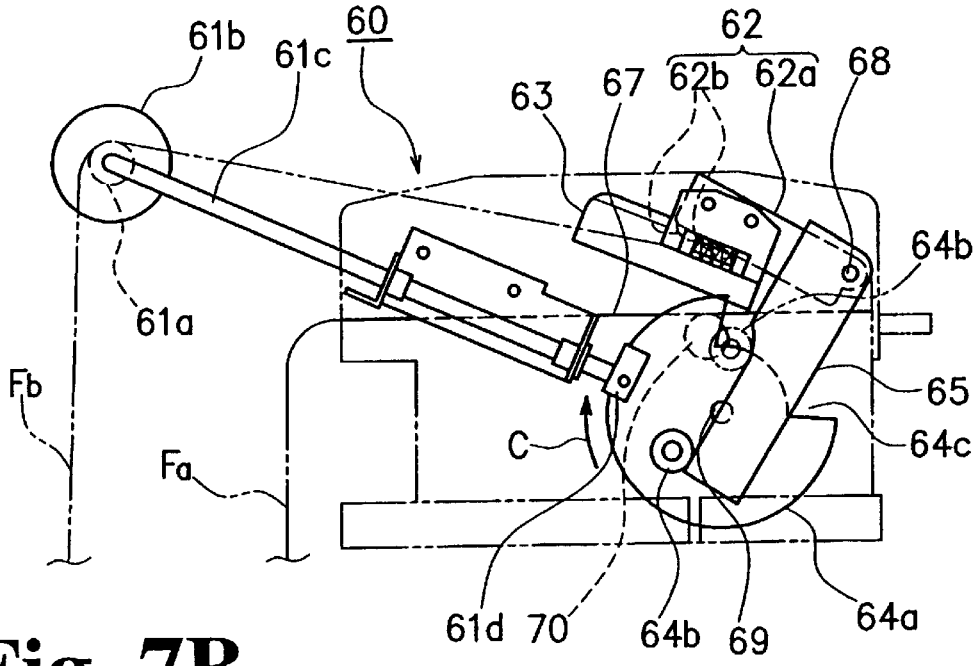
FIGS. 7A and 7B are schematic side and front views, respectively, of the operation of the film holding supply mechanism shown in FIG. 6.
Figure 7B:
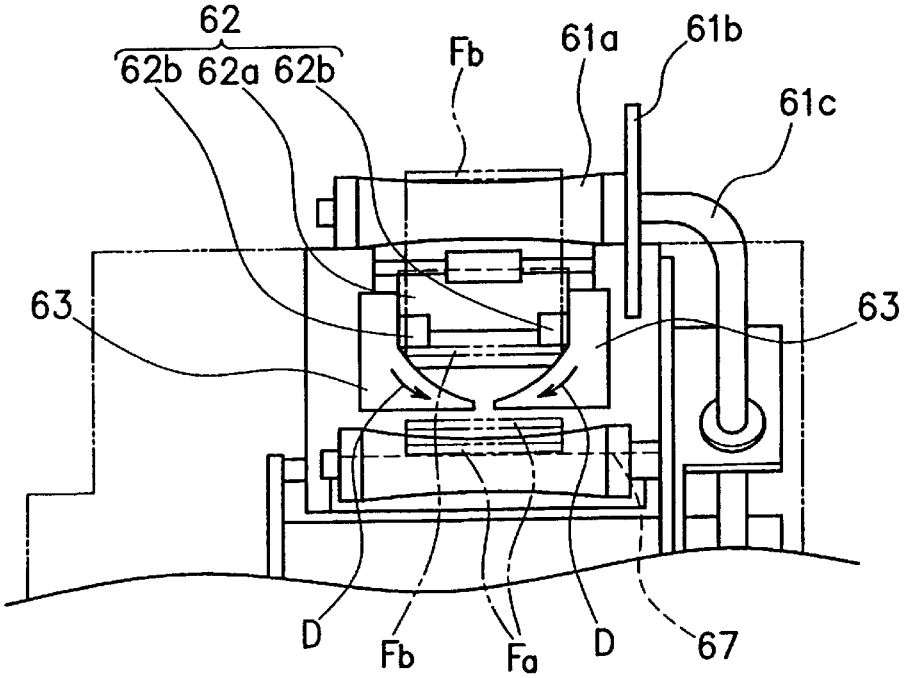
Figure 8A:
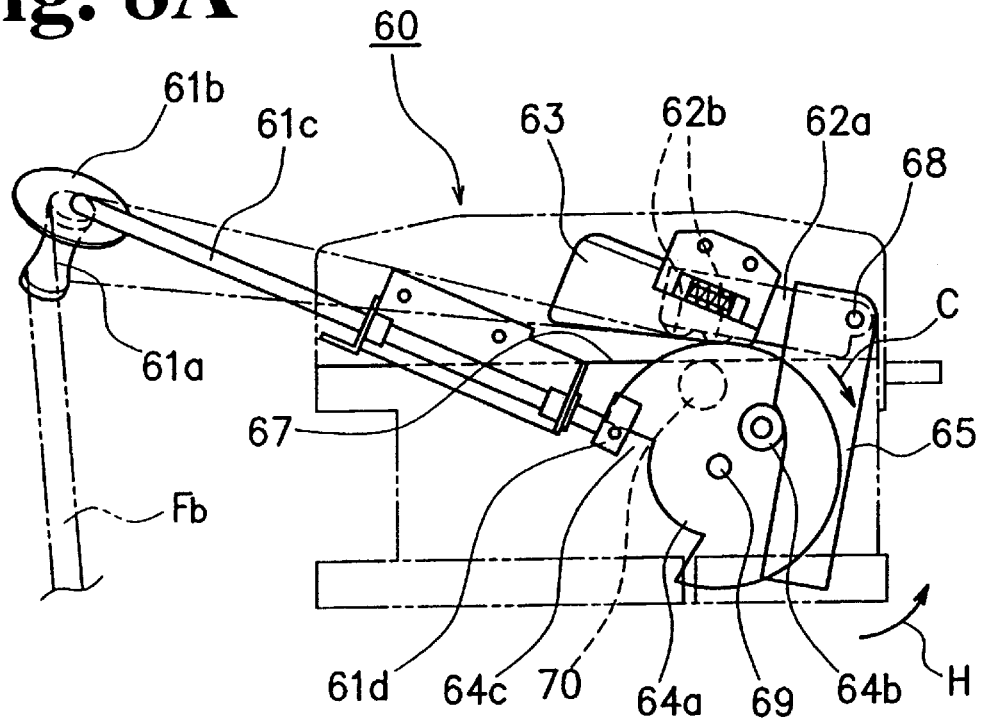
FIGS. 8A and 8B are schematic side and front views, respectively, of the further operation of the film holding supply mechanism shown in FIG. 6.

Further in the film holding supply mechanism 60 in accordance with this embodiment, the cam section 64 is configured so as to rotate in the direction of arrow C seen in FIG. 7A. This rotation of the cam section 64 will cause the hook section 71 and the switching guide section 62 to operate in a manner described below. Additionally, until the protruding section 64*b* reaches the location shown with the hypothetical line (two dot chain line), both the protruding section 64*b* and a notch section 64*c* do not interfere with any other elements so rotation of the cam section 64 within this range will not especially contribute to movement of the other elements.

As shown in FIG. 7A, the second film Fb is kept at the film waiting position until the first film Fa is transferred to a suitable location. After the first film is transferred to the suitable location, subsequent processing to transfer the second film Fb from the film waiting position to the film supply position is performed.

The film holding supply mechanism 60 in accordance with this embodiment is configured so that when the first film Fa is sent to a suitable location, a signal indicating this fact is communicated to a driving device of the cam section 64 through a sensor, a controller, etc., so as to start the rotating motion of the cam section 64 around the cam section rotating shaft 69.

FIG. 8 shows that in the film holding supply mechanism in accordance with this embodiment, the transfer of the first film Fa to the predetermined location is completed and the second film Fb held at the film waiting position begins to be transferred from the film waiting position. That is, FIG. 8 shows that the cam section 64 is rotated in the direction of arrow C for moving the second film Fb to the film supply position with the protruding section 64b contacting with the rod section 65. Additionally, in this embodiment, each element is configured so that a cam contact section 61*d* of the hook section 61*d* starts to move into the notch section 64*c* provided at the cam main section 64*a* when the protruding section 64*b* contacts with the rod section 65.

In accordance with the film holding supply mechanism shown in FIG. 8, the rotation of the cam section 64 about the cam section rotating shaft 69 in the direction of arrow C causes the protruding section 64 to contact with the rod section 65. That is, the rod section 65 is pushed by the rotation of the protruding section 64*b* in the direction of arrow C and, the rod section 65 and the switching section 62 (or its main section 62*a*) connected thereto will rotate about the rod section rotating shaft 68 in a direction of arrow H seen in FIG. 8.

Figure 8B:
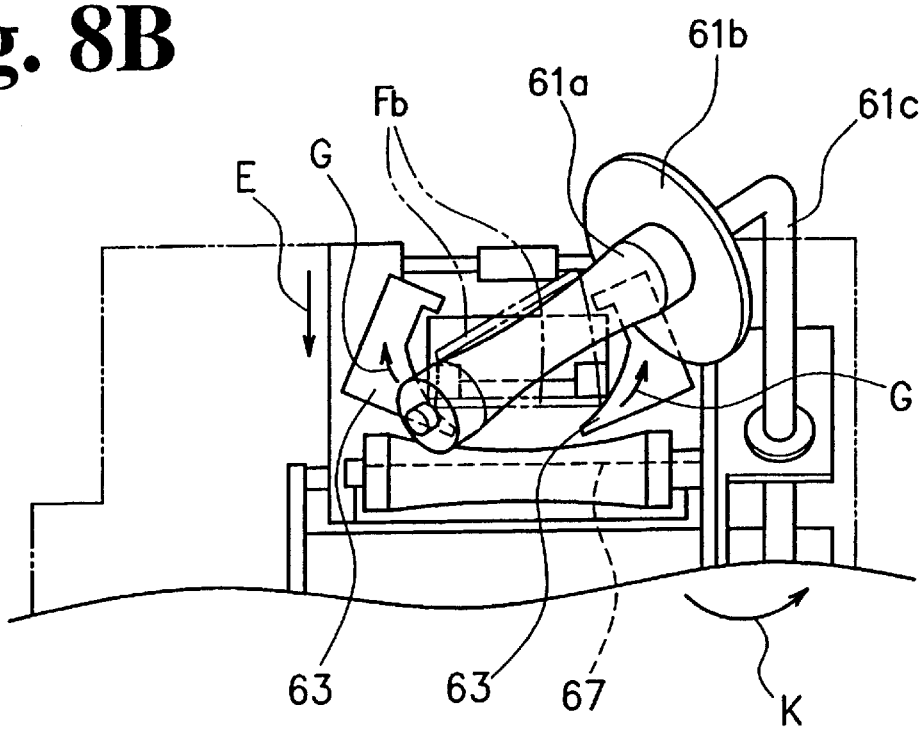

The movement of the switching guide section 62 during the rotation represents a downward movement (in the direction of arrow E) in FIG. 8B. Then, the movement of the switching guide section 62 in the direction of arrow E causes the left and right parts of the open-close guide section 63 to start to open in the left and right outward directions. This movement of the switching guide section 62 causes the second film Fb to start moving down. During this time, the roller section 62*b* of the switching guide section 62 acts so as to push the perforation section of the second film F*b*.

At the same time as the above described contact of the protruding section 64*b* with the rod section 65, the cam contact section 61*d* of the hook section 61*d* starts moving into the notch section 64*d* formed in the cam main section 64*a*. That is, the contact condition between the cam contact section 61*d* and the cam main section 64*a* is changed.

Since the holding section 61*a* and the side surface guide section 61*b* are provided at one end of the shaft section 61*c*, the shaft 61*c* and the holding section 61*a* inherently hang down due to their own weight. But in accordance with the film holding supply mechanism of this embodiment, as shown in FIGS. 6 and 7, the holding section 61*a* will be held at an angle so that the film can be kept by way of the contact of the cam contact section 61*d* with the cam main section 64*a*.

As described with reference to FIG. 8, since the contact condition of the cam contact section 61*d* with the cam main section 64*a* is changing (the cam contact section 61*d* starts moving into the notch section 64*c*), the weight of the holding section 61*a*, etc. will cause the shaft section 61*c* to start rotating in the direction of arrow K and the second film Fb will start separating from the holding section 61*a*.

FIG. 9 shows that the cam section 64 is rotated about the cam section rotating shaft 69 in the direction of arrow C.

FIG. 9 shows that in the film holding supply mechanism in accordance with this embodiment, the second film Fb held at the film waiting position is moved to the film supply position.

The cam section 64 shown in FIG. 9 is seen to rotate about the cam section rotating shaft 69 in the direction of arrow C from the condition shown in FIG. 8.

As the cam section 64 is rotated, the rod section 65 will be further pushed by the protruding section 64*b* and, the rod section 65 and the switching guide section 62 connected thereto are further rotated about the rod section rotating shaft 68 in the direction of arrow H from the condition of FIG. 8.

The movement of the switching guide section 62 during this rotation results in its downward movement (in the direction of arrow E). Then, the movement of the switching guide section 62 in the direction of arrow E (downward pushing of the switching guide section 62) causes the left and right parts of the open-close guide section 63 to open further in the left and right outward directions (the directions of arrow G) from the condition of FIG. 8B. This movement of the switching guide section 62 makes the second film Fb become nipped between the roller section 62*b* of the switching guide section 62 and a driving roller 70 provided at the film transfer passage 67. Herein, the roller section 62*b* contacts with the perforation section of the second film Fb.

Also, as described above, as the cam section 64 rotates further from the condition of FIG. 8 in the direction of arrow C, the cam contact section 61*d* will move completely into the notch section 64*c* formed in the cam main section 64*a*. In such a condition, since the cam contact section 61*d* fixed to the other end of the shaft section 61*c* will not contact with any elements, the shaft section 61*c* will rotate due to the weight of the holding section 61*a*. The holding section 61*a* will hang down and it can not hold the film. In other words, the second film can be readily separated from the holding section 61*a*.

That is, in the film holding supply mechanism 60 according to this embodiment, the hook section 61*d* rotates 90 degrees for allowing the film down since it is linked with the movement of the film from the film waiting position to the film supply position. According to the film holding supply mechanism of this embodiment, as shown in FIG. 9, the second film Fb can be readily moved onto the film transfer passage since the switching guide section 62 and the hook section 61*d* operate in accordance with the movement of the cam section 64 as shown in FIG. 9. That is, the second film Fb may be automatically and readily moved from the film waiting position to the film supply position.

In FIG. 9, according to this embodiment, the driving roller 70 is rotated clockwise in the film supply direction with the second film nipped between the roller section 62*b* and the driving roller 70. By doing this, the second film Fb is supplied from the film holding supply mechanism to the film mask not shown. This transfer condition using the driving roller 70 is performed until the second film Fb is nipped with a transfer roller section in the film mask (not shown). As the second film Fb is nipped with this transfer roller section, the second film Fb is subsequently supplied into the apparatus without any delay.

Accordingly, after the second film Fb has been nipped with the transfer roller section within the film mask, the switching guide section 62 will be returned to the film waiting position since the second film Fb does not need to be nipped by the switching guide section 62 and the driving roller 70.

Specifically, from the condition shown in FIG. 9, the cam section 64 is further rotated about the cam section rotating shaft 69.

Figure 9A:
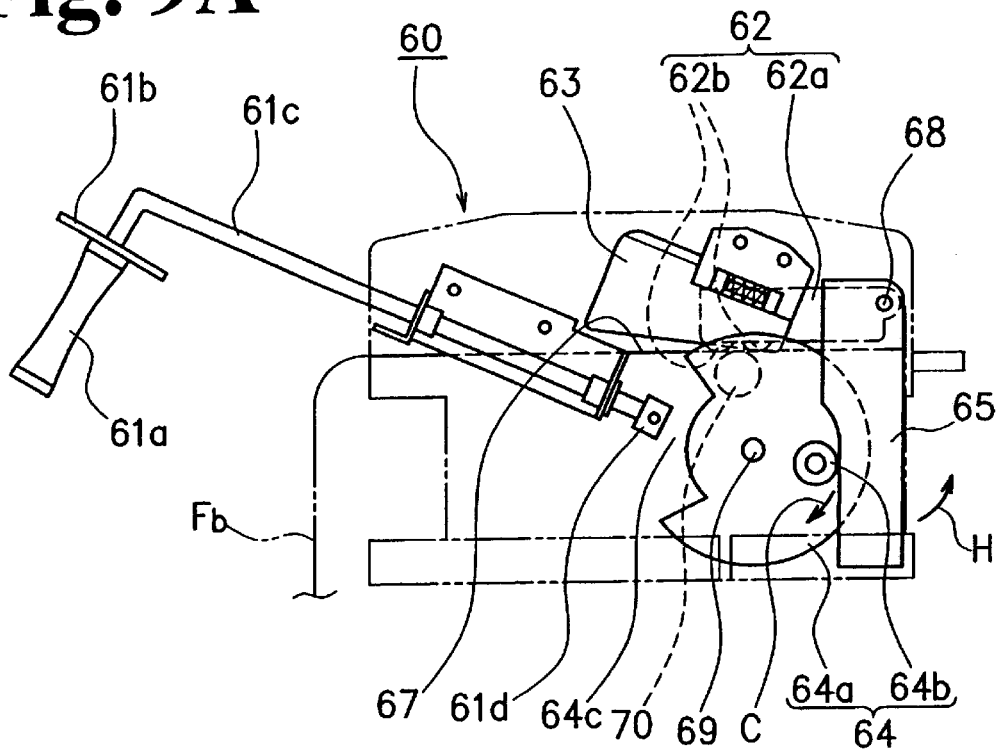
FIGS. 9A and 9B are schematic side and front views, respectively, of the further operation of the film holding supply mechanism shown in FIG. 6.
Figure 9B:
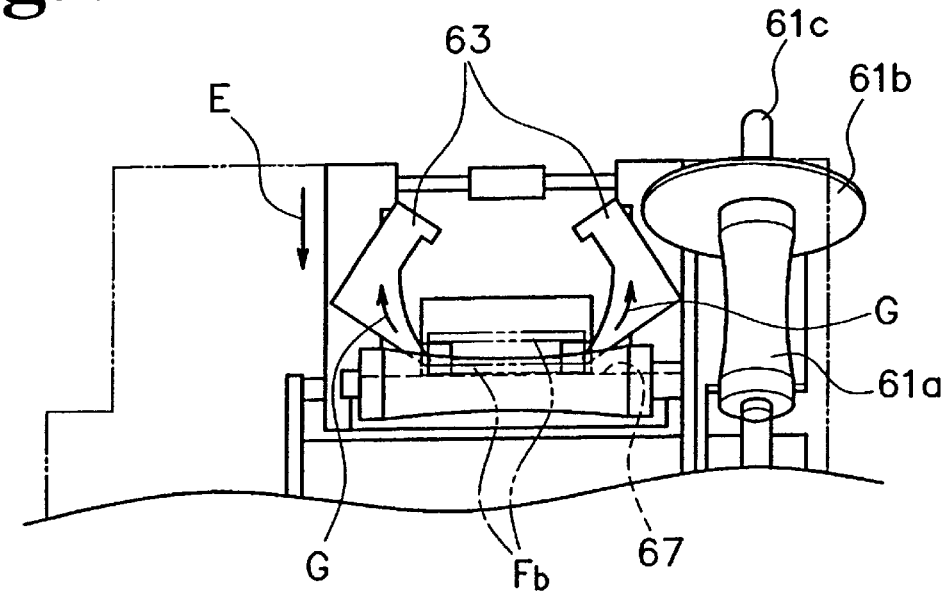

As the cam section 64 is rotated in the direction of arrow C, the protruding section 64*b* is moved in a direction departing from the rod section 65 and the rod section 65 is moved in an opposite direction to the arrow H of FIG. 9A since the rod section 65 is inherently acted on with the opposite force to arrow H rotating about the rod section rotating shaft 68. The rotation of the rod section 65 about the rod section rotating shaft 68 in the direction opposite to the arrow H results in the switching guide section 62 separating from the driving roller 70 and moving upwards. With the upward movement of the switching guide section 62, the left and right parts of the open-close guide section 63 operate to inwardly close (see the arrow D in FIG. 7B).

Also regarding the hook section 61, rotating the cam section 64 in the direction of arrow C from the condition of FIG. 9 results in the cam contact section 61*d* again contacting with the cam main section 64*a*. Accordingly, the hook section will be returned to the condition of FIG. 7 as will the rod section 65, the switching guide section 62 and the open-close guide section 63.

That is, the film holding supply mechanism according to this embodiment can rotate the cam section 64 and return the hook section 61*d* and the switching guide section 62 to the film waiting position even if the film is transferred on the film transfer passage.

Accordingly, the film holding supply mechanism according to this embodiment can allow another film (herein the second film Fb ) at the film waiting position using the hook section 61*d* and the switching guide section 62 since they have returned to the film waiting position (see the description related to FIG. 7 for the way of adding the new film). That is, the condition of the second film results in the placement condition of FIG. 7.

As described above and similar to the embodiment described with reference to FIGS. 1–5, this embodiment can also set the second film using the hook section 61, the switching guide section 62 and the open-close guide section 63 during the processing of the first film while the operator is waiting. This is because the film holding supply mechanism 60 is in the film waiting condition as the first film is transferred by the transfer roller within the film mask. That is, this embodiment can set the second film as soon as the processing of the first film is commenced and can set the second film even if the first film is being processed.

Further, even during the setting and the processing for each film, one film does not contact the other film.

Accordingly, this embodiment can eliminate lost time during setting and placement of the film and can efficiently operate the photo processing apparatus since the next film starts to be supplied and transferred automatically into the film mask while the operation of the film during the processing is being performed. That is, the film previously set is automatically supplied after the completion of the processing of the first film. Additionally, the film supply apparatus according to this embodiment does not need large space and can be implemented with a reduced cost since it does not have the complicated structure of the second prior art structure and it is configured in a relatively simple manner. Further, the film can not be damaged since the films do not contact each other as in the second prior art structure and the second film can be set while the first film is being processed since they are not overlayed.

That is, according to this embodiment, the film supply apparatus with a relatively simple structure can be implemented wherein one film is held in the waiting condition while the other film is being processed. The processing of the film that is waiting is automatically commenced after the processing of the first film is completed and then the next film can be prepared during the processing of the previously waiting film.

While a specific location for using the film supply apparatus has not been explained in detail, the location for using this film supply apparatus is not limited to any specific location. Accordingly, it can be used, for example, in supplying the film to the scanning apparatus or in supplying the film to the exposure apparatus.

According to this invention, as described above, the film supply apparatus can be provided wherein one film is held in the waiting condition while another film is being processed and the film that is waiting can be automatically commenced after the processing of the film has been completed.

Also, according to this invention, since the film waiting position can be in one location, the operation can be simplified and then work efficiency of the operator can be improved. Further, compared to the prior art structures, since another lane for setting the film is unnecessary, compactness of the apparatus itself (the film holding support mechanism or film supply apparatus) can be achieved. Also, in this invention, the film supply apparatus is configured so as to be present just below the film waiting position. Accordingly, the apparatus can be implemented with a relatively small space as well as transferring one film from the film waiting position to the film supply position with a simple mechanism (for example, a vertical mechanism such as the film moving device and the switching guide mechanism).

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A film supply apparatus comprising a film holding supply mechanism, said film holding supply mechanism including a film nip section that nips a first film at a film waiting position, a film moving means for moving the first film from the film waiting position to a film supply position and a driving means for contacting the first film so the first film can be nipped between a portion of said film moving means and said driving means when the first film is in the film supply position and for transferring the first film between said driving means and said film moving means, wherein said film moving means is configured for returning to the film waiting position after a predetermined portion of the first film has been transferred, and wherein after said film moving means has returned to the film waiting position, another film can be nipped by said film nip section at the film waiting position prior to the first film being completely transferred from the film supply position.

2. A film supply apparatus as defined in claim 1, further comprising a film holding means for operating with said film nip section and holding the film at the film waiting position and a film supply roller section, wherein said film holding means is inclined at an angle so that the film is apt to move from said film holding means to said film supply roller section.

3. A film supply apparatus as defined in claim 1, further comprising a film mask provided downstream of said film holding supply mechanism, wherein said film mask comprises a transfer roller section that nips and transfers film supplied from said film holding supply mechanism, and wherein said film moving means returns to the film waiting position after said transfer roller section has nipped the film.

4. A film supply apparatus as defined in claim 2, further comprising a film mask provided downstream of said film holding supply mechanism, wherein said film mask comprises a transfer roller section that nips and transfers film supplied from said film holding supply mechanism, and wherein said film moving means returns to the film waiting position after said transfer roller section has nipped the film.

5. A film supply mechanism as defined in claim 1, wherein said film supply position is located just beneath said film waiting position.

6. A film supply apparatus comprising a film holding supply mechanism including a film holding section holding a film at a film waiting position, a moving means for moving the film from the film waiting position to a film supply position and a driving means for transferring the film at the film supply position, wherein said moving means returns to the film waiting position after a predetermined portion of the film has been transferred and wherein after said moving means has returned to the film waiting position, another film can be nipped by said film holding section at the film waiting position prior to the first film being completely transferred from the film supply position.

7. A film supply apparatus as defined in claim 6, wherein said film holding section comprises a switching guide section and an open-close guide section located under the film, wherein said open-close guide section operates in an opening direction when said switching guide section moves downward and operates in a closing direction when said switching guide section moves upward, wherein at the film waiting position the film is nipped using said switching guide section and said open-close guide section, wherein in moving the film to the film supply position said switching guide section functions as said moving means by moving from upper to lower sides of the film, and wherein after a predetermined portion of the film has been transferred using said switching guide section and said driving means, said switching guide section and said open-close guide section return to the film waiting position.

8. A film supply apparatus as defined in claim 6, further comprising a hook section which operates with said film holding section to hold the film at the film waiting position, wherein said hook section is driven to rotate so as to release a holding condition of said hook section with respect to the film in moving the film from the film waiting position to the film supply position.

9. A film supply apparatus as defined in claim 7, further comprising a hook section which operates with said film holding section to hold the film at the film waiting position, wherein said hook section is driven to rotate so as to release a holding condition of said hook section with respect to the film in moving the film from the film waiting position to the film supply position.

10. A film supply apparatus according to claim 8, wherein said film holding section and said hook section are driven linked with each other.

11. A film supply apparatus as defined in claim 7, further comprising a film mask provided downstream of said film holding supply mechanism, wherein said film mask comprises a transfer roller section that nips and transfers the film supplied from said film holding supply mechanism, and wherein said switching guide section returns to the film waiting position after said transfer roller section has nipped the film.

12. A film supply mechanism as defined in claim 6, wherein said film supply position is located just beneath said film waiting position.

13. A film supply apparatus comprising a film holding supply mechanism, said film holding supply mechanism including a film nip section that nips a film at a film waiting position, a film moving device moving the film from the film waiting position to a film supply position and a driving mechanism for contacting the first film so the first film can be nipped between a portion of said film moving device and said driving mechanism when the first film is in the film supply position and for transferring the film between said driving mechanism and said film moving device, wherein said film moving device is configured for returning to the film waiting position after a predetermined portion of the film has been transferred, and wherein after said film moving device has returned to the film waiting position, another film can be nipped by said film nip section at the film waiting position prior to the first film being completely transferred from the film supply position.

14. A film supply apparatus as defined in claim 13, further comprising a film holding device operating with said film nip section and holding the film at the film waiting position and a film supply roller section, wherein said film holding device can be inclined at an angle so that the film is apt to move from said film holding device to said film supply roller section.

15. A film supply apparatus as defined in claim 13, further comprising a film mask provided downstream of said film holding supply mechanism, wherein said film mask comprises a transfer roller section that nips and transfers film supplied from said film holding supply mechanism, and wherein said film moving device returns to the film waiting position after said transfer roller section has nipped the film.

16. A film supply apparatus as defined in claim 14, further comprising a film mask provided downstream of said film holding supply mechanism, wherein said film mask comprises a transfer roller section that nips and transfers film supplied from said film holding supply mechanism, and wherein said film moving means returns to the film waiting position after said transfer roller section has nipped the film.

17. A film supply mechanism as defined in claim 13, said film moving device further comprises a cam section and a hook section that cooperate with one another so as to allow the film to move from the film waiting position to a film supply position.

* * * * *